US006450101B2

(12) United States Patent
Theurer et al.

(10) Patent No.: US 6,450,101 B2
(45) Date of Patent: Sep. 17, 2002

(54) MACHINE FOR RENEWING A TRACK

(75) Inventors: Josef Theurer, Vienna; Manfred Brunninger, Altenberg, both of (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/898,739

(22) Filed: Jul. 2, 2001

(30) Foreign Application Priority Data

Jul. 13, 2000 (AT) ..... 512/00 U

(51) Int. Cl.[7] ..... E01B 27/00
(52) U.S. Cl. ..... 104/2; 104/7.3; 104/9
(58) Field of Search ..... 104/2, 6, 7.1, 7.2, 104/7.3, 12; 37/104, 105, 106, 107

(56) References Cited

U.S. PATENT DOCUMENTS 4,094,249 A * 6/1978 Theurer et al. ..... 104/6
4,160,418 A * 7/1979 Theurer ..... 104/2
4,774,890 A * 10/1988 Theurer ..... 104/7.1
4,854,243 A * 8/1989 Theurer ..... 104/7.3
5,479,725 A * 1/1996 Theurer et al. ..... 37/104

FOREIGN PATENT DOCUMENTS

FR 2 736 367 A 4/1996

* cited by examiner

*Primary Examiner*—Mark T. Le
(74) *Attorney, Agent, or Firm*—Henry M. Feiereisen

(57) ABSTRACT

A track renewal machine includes an elongate machine frame supported by undercarriages on the track and having front and rear frame parts connected by a frame joint. In an upper region, the frame parts are interconnected by a drive by which the frame parts can be spread apart and raised in a vertical direction at the frame joint. A rotatable endless ballast clearing device is mounted between tie lifting and tie laying devices which are mounted on the machine frame between the undercarriages. A first conveyor cooperates with the ballast clearing device for transporting away removed ballast, and a second conveyor for transporting ballast has a discharge end arranged between the ballast clearing device and the tie laying device. A ballast discharge device is associated with the discharge end of the second conveyor, and a vertically adjustable ballast planing device is arranged between the ballast clearing and tie laying devices.

7 Claims, 2 Drawing Sheets

MACHINE FOR RENEWING A TRACK

CROSS-REFERENCES TO RELATED APPLICATIONS

This application claims the priority of Austrian Patent Application Ser. No. GM 512/2000, filed Jul. 13, 2000, the subject matter of which is incorporated herein by reference.

BACKGROUND OF THE INVENTION

The present invention relates, in general, to a track renewal machine.

U.S. Pat. No. 4,854,243 describes a machine for renewing a track composed of two rails fastened to ties supported on ballast. The track renewal machine includes a machine frame extending in a longitudinal direction and having opposite ends supported on the track by undercarriages. The machine frame has a front frame part and a rear frame part, arranged one following the other in the longitudinal direction, with a frame joint connecting the front and rear frame parts to one another. Drives interconnect the front and rear frame parts in an upper region thereof to spread the frame parts apart, whereby the frame parts are raised in a vertical direction at the frame joint. The machine further includes a tie lifting device and a tie laying device, mounted on the machine frame between the undercarriages and spaced from one another in the longitudinal direction; an endless ballast clearing device for taking up ballast, mounted on the machine frame between the tie lifting device and the tie laying device and designed to be set in rotation by a drive; and first conveyor, cooperating with the ballast clearing device, for transporting away taken-up ballast. After removal of the old ties, ballast from the cribs between the ties remains lying on the ballast bed, creating an obstacle for laying the new ties. This crib ballast is taken up by the ballast clearing device, having the shape of an endless chain, and is transported upwards to the conveyor. After being moved to the rear end of the machine, the ballast is discharged upon the new track which has been laid in the meantime in the intervening space. This serves to ballast the new ties resting on the newly graded ballast bed and thus to stabilize the track position.

French Pat. No. FR 2 736 367 A describes a track renewal machine which essentially includes a first machine unit for picking up the old ties, a trailing ballast cleaning unit, and a further machine unit for laying the new ties. The ballast cleaning unit includes a clearing chain which cooperates with a ballast screen in which the soiled ballast is cleaned. Located immediately behind the clearing chain in the operating direction is a ballast discharge station for returning cleaned ballast to the track, and a planing and consolidating device.

It would be desirable and advantageous to provide an improved track renewal machine which is optimally suited for track renewal work and yet can be simultaneously also employed for cleaning an exposed or excavated ballast bed.

SUMMARY OF THE INVENTION

According to one aspect of the present invention, a machine for renewing a track composed of two rails fastened to ties supported on ballast, includes a machine frame extending in a longitudinal direction and having opposite ends supported on the track by undercarriages, wherein the machine frame includes a front frame part and a rear frame part, arranged one following the other in the longitudinal direction, a frame joint connecting the front and rear frame parts to one another, and a drive interconnecting the front and rear frame parts in an upper region thereof and effective to spread the frame parts apart, wherein the frame parts are raised in a vertical direction at the frame joint; a tie lifting device and a tie laying device, mounted on the machine frame between the undercarriages and spaced from one another in the longitudinal direction; a rotatable endless ballast clearing device, mounted on the machine frame between the tie lifting device and the tie laying device, for taking up ballast; a first conveyor, cooperating with the ballast clearing device, for transporting away taken-up ballast; a second conveyor for transporting ballast, said second conveyor extending in the longitudinal direction and having a discharge end arranged between the ballast clearing device and the tie laying device; a ballast discharge device associated with the discharge end of the second conveyor; and a ballast planing device arranged between the ballast clearing device and the tie laying device and including a drive for vertically adjusting the ballast planing device.

Through the provision of a track renewal machine according to the present invention with two-part machine frame of articulated design which is supported at opposite ends on the track by undercarriages, it is now possible in a particularly advantageous manner to exploit the renewal gap, which is easily accessible as a consequence of a temporary removal of the track, for taking up ballast in a simplified and problem-free way. Since there is no track present in the renewal gap to create an obstacle, it now is very easy to clean even especially problematic areas, such as platforms, for example, where, in the course of normal cleaning operations with lifting of the track, there would normally not be sufficient space for operating a clearing chain.

An added advantage can be found in the possibility to precisely control or guide the vertical position of the clearing chain or the ballast planing device by tracing the vertical position of the immediately preceding old ties before the removal thereof, in order to accurately re-establish the track position. Thus, the pre-existing vertical position of the old track can be precisely reproduced by the new track. When the ballast clearing chain is moved to its idle position on the machine frame, the track renewal machine can be employed without any restrictions for regular track renewal operations, without involving cleaning of the ballast bed. As the track renewal machine is supported on undercarriages only at the opposite ends of the machine frame, it is possible to easily produce an exactly planed and consolidated ballast formation for the new track position.

BRIEF DESCRIPTION OF THE DRAWING

Other features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
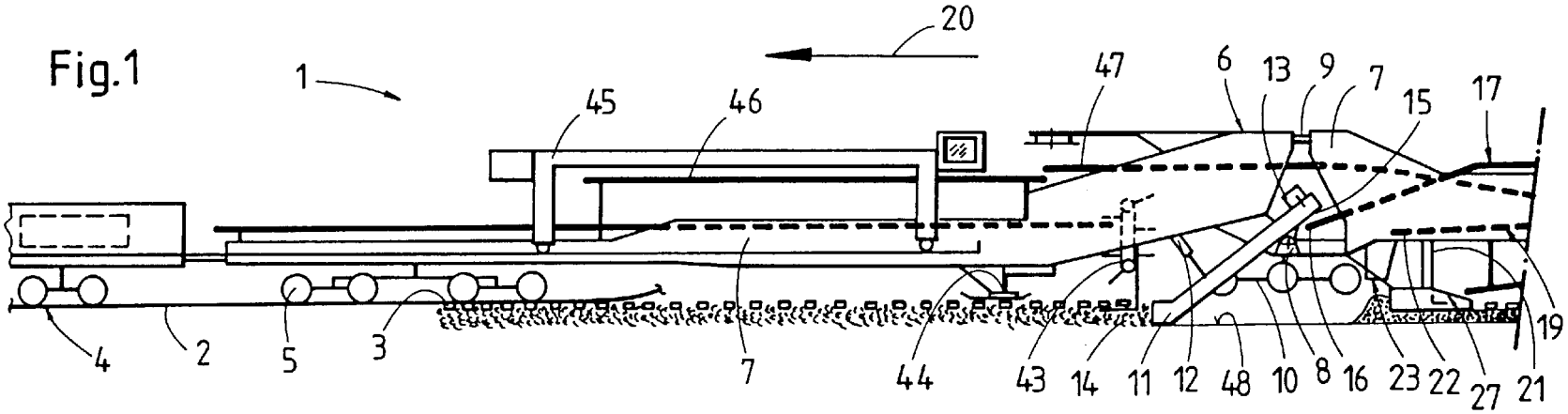
FIG. 1 is a schematic side elevational view of a front portion of a track renewal machine according to the present invention.

This is one of three applications filed on the same day. All three applications deal with related inventions. They are commonly owned and have the same inventive entity. All three applications are unique, but incorporate the other by reference. Accordingly, the other U.S. patent applications 09/898,738 and 09/898,719, both of which are filed on Jul. 2, 2001, entitled "Machine for Renewing a Track" and "Machine for Removing an Old Track and Laying a New Track" are hereby expressly incorporated by reference.

Throughout all the Figures, same or corresponding elements are generally indicated by same reference numerals.

Figure 2:
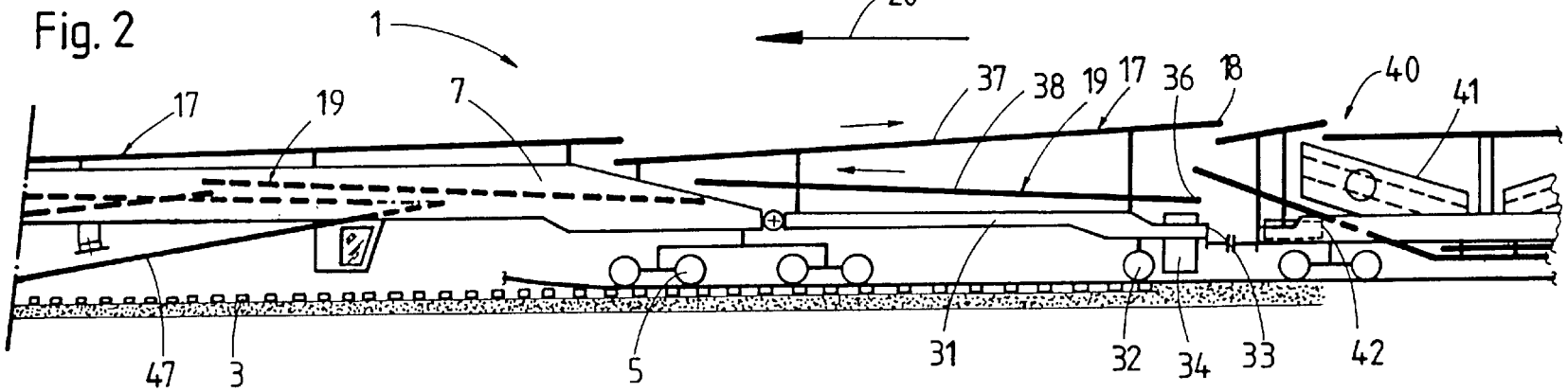
FIG. 2 is a schematic side elevational view of a rear portion of the track renewal machine.

Turning now to the drawing, and in particular to FIGS. 1 and 2, there is shown a track renewal machine, generally designated by reference numeral 1 for renewing a track 4. The track 4 is composed of two rails 2 fastened to ties 3 which rest on ballast 14. The track renewal machine 1 includes an elongated machine frame 6 which extends longitudinally in a direction along the track 4 and has opposite ends supported on the track 4 by two undercarriages 5 for mobility in an operating direction indicated by arrow 20. The machine frame 6 has front and rear frame parts 7 arranged behind one another in the longitudinal direction and articulatedly connected to one another by a frame joint 8. A drive 9 interconnects the frame parts 7 in the region above the frame joint 8 and serves to spread the frame parts 7 apart in a horizontal direction and to thereby cause the frame parts to be raised in a vertical direction at their ends connected by the frame joint 8. An additional undercarriage 10 located underneath the frame joint 8 is thereby also raised off the track 4. The drive 9 is further effective to steer the articulated machine frame 6, when traveling in track curves with the undercarriage 10 in the raised position.

In the region of the frame joint 8, a ballast clearing device 11 is mounted on the machine frame 6 for vertical adjustment by a drive 12. The ballast clearing device 11 is equipped with an endless chain, which is rotated by a drive 13 and picks up ballast 14 of the track 4 for transport to a discharge end 15. A first conveyor 17 extends in the longitudinal direction along the machine frame 6 and has a discharge end 18 and a receiving end 16 which is associated with the discharge end 15 of the ballast clearing device 11. Provided underneath the first conveyor 17 and also extending in the longitudinal direction is a second conveyor 19, having a discharge end 22 which is arranged immediately ahead—with regard to the operating direction shown by arrow 20—of a tie laying device 21 mounted on the machine frame 6. A ballast discharge device 23 is located underneath the discharge end 22 of the second conveyor 19 and includes a chute 24 with outlet openings 25, as shown in particular in FIG. 3.

Figure 3:
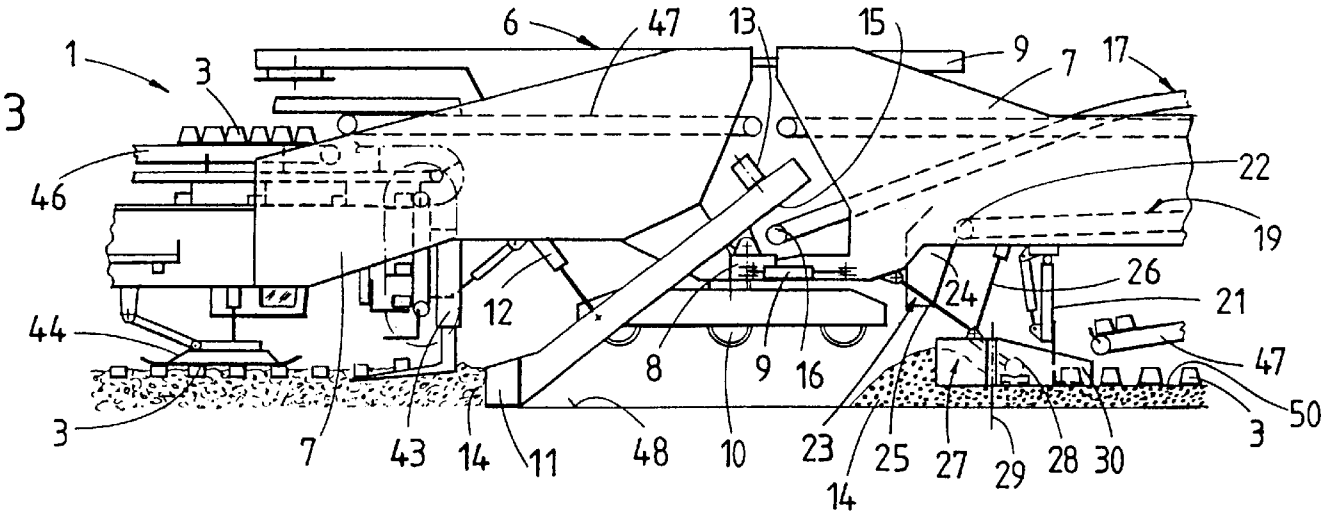
FIG. 3 is a side elevational cutaway view, on an enlarged scale, of a middle portion of the track renewal machine.

As can be seen more clearly in FIG. 3, a ballast planing device 27 is positioned between the tie laying device 21 and the immediately preceding ballast discharge device 23, and is connected to a vibratable ballast consolidating unit 28 and designed for vertical adjustment by drives 26. Additionally, the ballast planing device 27 includes two plow shields 30 which are positioned at either side of the tie laying device 21, respectively, and spaced from one another transversely to the longitudinal direction. Each plow shield 30 is pivotable about a vertical axis 29.

Figure 4:
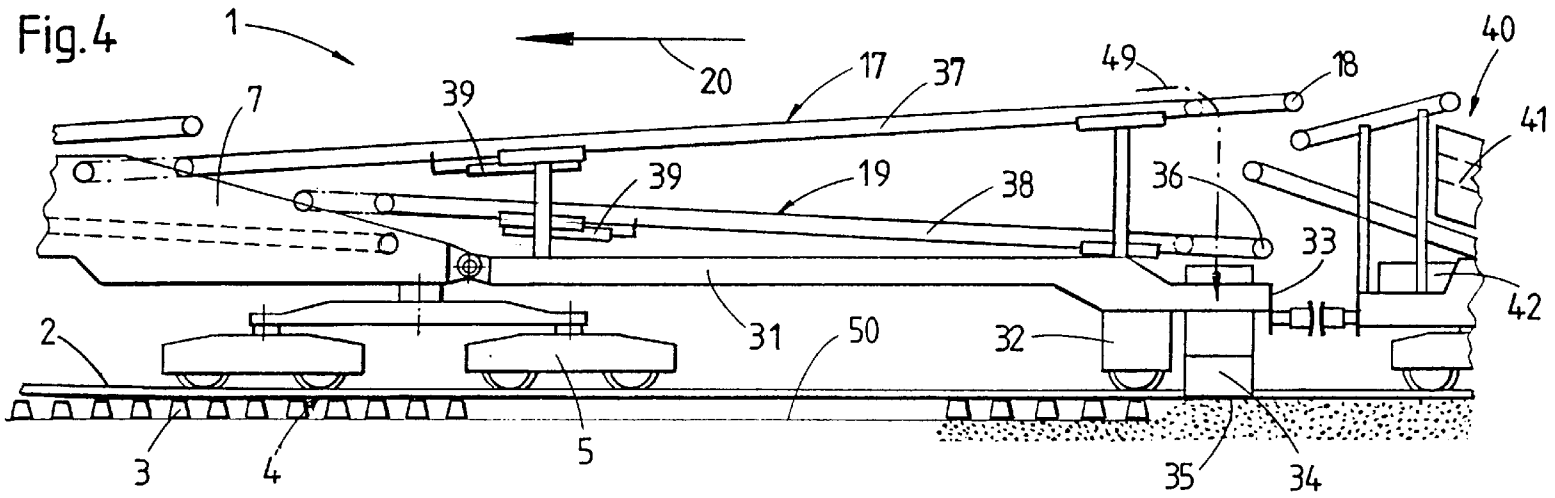
FIG. 4 is a side elevational cutaway view, on an enlarged scale, of the rear portion of the track renewal machine.

As shown in FIG. 2 and, more particularly, in FIG. 4, the rear frame part 7, following in the operating direction, is provided with an extension in the shape of a frame 31 supported in a trailer-like manner on an undercarriage 32. Thus, a working space for screwing operations on the track 4 is created under the frame 31. A ballast chute 34, having outlet openings 35 distanced from one another transversely to the longitudinal direction, is arranged at a machine end 33 which is located immediately behind the undercarriage 32 (FIG. 4). A receiving end 36 of the second conveyor 19 is positioned above the ballast chute 34.

As illustrated in FIG. 4, the first conveyor 17 has a rear conveyor belt 37, and the second conveyor 19 has a further rear conveyor belt 38. Both rear conveyor belts 37 and 38 are supported on the frame 31 and are mounted for displacement in the longitudinal direction by means of a respective drive 39. A screening car 40 is coupled to the rear machine end 33 and includes a vibratable screening installation 41 for cleaning ballast and a motor unit 42 for supplying energy.

A tie lifting device 43 is arranged on the machine frame 6 immediately ahead of the ballast clearing device 11 in the operating direction of the machine 1. A tracing device 44 for tracing the vertical position of the old ties 3 is arranged on the front frame part 7 of the machine frame 6 immediately ahead of the tie lifting device 43. A gantry crane 45 is mounted for mobility on the front frame part 7 and serves to remove the old ties 3 and to deliver new ties 3 to a conveyor unit 46 attached to the front frame part 7. The new ties 3 are then delivered to the tie laying device 21 by means of a tie conveyor 47 which extends in the longitudinal direction along the machine frame 6.

The track renewal machine 1 operates as follows: At the start of working operations, the two frame parts 7 are spread against one another in the horizontal direction by actuation of the drive 9, causing the undercarriage 10 located underneath the frame joint 8 to be raised off the track 4. As the track renewal machine 1 advances continuously in the direction of arrow 20, the old ties 3 are picked up from the ballast 14 with the aid of the tie lifting device 43 and removed by the gantry crane 45. At the same time, all of the ballast 14 is taken up by the ballast clearing device 11 lowered into the operating position, thus exposing an earth formation 48. The ballast 14 is delivered via the first conveyor 17 to the screening installation 41 and cleaned therein. Subsequently, the cleaned ballast 14 is transported by the second conveyor 19 to the ballast discharge device 23 and dropped immediately in front of the tie laying device 21. At this location, the ballast 14 is then planed by means of the ballast planing device 27 and directly thereafter compacted by the ballast consolidating unit 28. The new ties 3 are now laid upon the resulting planed and compacted new ballast formation 50 by the tie laying device 21.

According to a variation of working operations, it is also possible to employ the track renewal machine 1 without a screening car 40. In this case, the ballast clearing device 11 is used to remove only ballast which remains from the cribs between the old ties 3, thus creating a ballast formation 50. While the two rear conveyor belts 37,38 of the conveyors 17 and 19 are correspondingly displaced in the longitudinal direction, the removed tie crib ballast is discharged into the ballast chute 34 (see dash-dotted arrow 49 in FIG. 4) and used to ballast the new ties 3 laid upon the ballast formation 50, thus stabilizing the track position.

Finally, in a third operational variation, the track renewal machine 1 may be employed in a conventional way for renewing a track 4, without using the ballast clearing device 11 which is now in its idle position. In this instance, the desired ballast formation is created with the aid of the ballast planing device 27. Excess ballast stemming from the tie cribs is thereby displaced in a lateral direction onto the two shoulders of the ballast bed.

While the invention has been illustrated and described as embodied in a machine for renewing a track, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A machine for renewing a track composed of two rails fastened to ties supported on ballast, comprising:

(a) a machine frame extending in a longitudinal direction and having opposite ends supported on the track by undercarriages, wherein the machine frame includes a front frame part and a rear frame part, arranged one following the other in the longitudinal direction, a frame joint connecting the front and rear frame parts to one another, and drive means interconnecting the front and rear frame parts in an upper region thereof and effective to spread the frame parts apart, wherein the frame parts are raised in a vertical direction at the frame joint;

(b) a tie lifting device and a tie laying device, mounted on the machine frame between the undercarriages and spaced from one another in the longitudinal direction;

(c) a rotatable endless ballast clearing device, mounted on the machine frame between the tie lifting device and the tie laying device, for taking up ballast;

(d) a first conveyor, cooperating with the ballast clearing device, for transporting away taken-up ballast;

(e) a second conveyor for transporting ballast, said second conveyor extending in the longitudinal direction and having a discharge end arranged between the ballast clearing device and the tie laying device;

(f) a ballast discharge device associated with the discharge end of the second conveyor; and (g) a ballast planing device arranged between the ballast clearing device and the tie laying device and including a drive for vertically adjusting the ballast planing device.

2. The machine of claim 1, and further comprising a ballast consolidating unit arranged between the ballast planing device and the tie laying device, and drives for vertically adjusting and vibrating the ballast consolidating unit.

3. The machine of claim 1, wherein the ballast planing device includes two plow shields pivotable about respective vertical axes, wherein the plow shields are spaced from one another transversely to the longitudinal direction and positioned at either side of the tie laying device.

4. A track-bound machine, comprising:

an elongate machine frame supported on a track by undercarriages for travel in an operating direction, wherein the machine frame has an elevatable frame area to clear a renewal section;

a tie lifting device for lifting old ties from the renewal section;

a tie laying device trailing the tie lifting device on the machine frame for placing new ties on the renewal section;

a ballast clearing device, positioned on the machine frame between the tie lifting device and the tie laying device, for withdrawing ballast from the renewal section;

a cleaning device receiving withdrawn ballast from the ballast clearing device for subsequent cleaning;

a ballast discharge device, arranged between the ballast clearing device and the tie laying device, for receiving cleaned ballast and depositing cleaned ballast on the renewal section; and a ballast planing device arranged between the ballast clearing device and the tie laying device for leveling cleaned ballast.

5. The machine of claim 4, and further comprising a ballast consolidating unit arranged between the ballast planing device and the tie laying device, wherein the ballast consolidating unit is configured for vertical adjustment and vibration.

6. The machine of claim 4, wherein the ballast planing device includes two pivotable plow shields in spaced-apart relationship across the machine frame, wherein one plow shield is disposed on one side of the tie laying device, and the other plow shield is disposed on the other side of the tie laying device.

7. The machine of claim 4, and further comprising a tracing device, disposed on the machine frame in operating direction ahead of the tie lifting device, for tracing a vertical position of the old ties before the old ties are removed to thereby allow accurate laying of the new ties across the renewal section.

* * * * *